United States Patent [19]

Gartung

[11] 4,102,095

[45] Jul. 25, 1978

[54] MODULAR SCREEN ASSEMBLY

[75] Inventor: Clifford W. Gartung, Newport Beach, Calif.

[73] Assignee: Pleion Corporation, Santa Ana, Calif.

[21] Appl. No.: 760,004

[22] Filed: Jan. 17, 1977

[51] Int. Cl.[2] ..... E04B 2/56; E04C 3/32

[52] U.S. Cl. ..... 52/122; 52/239

[58] Field of Search ..... 52/239, 122, 238, 241

[56] References Cited

U.S. PATENT DOCUMENTS

| | | | |
|---|---|---|---|
| 2,169,274 | 8/1939 | Mills | 52/122 |
| 3,209,869 | 10/1965 | Hammitt | 52/239 |
| 3,257,763 | 6/1966 | Hammitt | 52/239 |
| 3,999,353 | 12/1976 | Dielman | 52/122 |

*Primary Examiner*—John E. Murtagh

*Attorney, Agent, or Firm*—Harold L. Jackson; Stanley R. Jones; Joseph W. Price

[57] ABSTRACT

An improved modular office screen system is provided having a hollow rigid frame member and a central sound-absorbing panel. Relatively movable support legs are adjustably mounted within the rigid frame member. A guide sleeve and fastener can form an aperture for receiving an upright channel of the support leg and further for adjustably holding a force bearing member to permit a subjective positioning of the support member relative to the frame member. Alternatively, a removable leg extension member can permit adjustment of the frame member when positioned above the floor.

18 Claims, 4 Drawing Figures

MODULAR SCREEN ASSEMBLY

BACKGROUND OF THE INVENTION

1. Field of the Invention

The present invention relates to modular office screens for providing movable sound-absorbing partitions for offices and the like. More particularly, the invention provides an improved construction of the interface components between the support leg and the rigid frame and provides adjustment thereof.

2. Description of the Prior Art

Various forms of detachable wall or screen partition systems are disclosed in the prior art and are used in commercial and residential environments. An example of a demountable partition system can be found in U.S. Pat. No. 3,766,696, and U.S. Pat. No. 3,768,222. The background environment of the present invention and the status of the prior art can be easily found from the inventor's earlier invention disclosed in U.S. Pat. No. 3,934,382 and the references cited therein.

While the basic purpose and function of a modular office screen partition system is well-known in the prior art, there is still a continual demand and need for a competitive relatively inexpensive screen partition system that is adaptable to variations in floor structure and floor elevations. For example, it is highly desirable that each individual vertical support of a multi-modular screen partition system be relatively adjustable to permit the top edge of the screen partition system to be aligned and level. It is also highly desirable for the wall screens to be optionally capable of extending substantially to the floor level or to be positioned a distance off the floor depending upon a particular environment and application.

A designer in this field must realistically contend not only with the ornamental appearance of the modular unit, but also with the practical and limiting design considerations of economics in order to complete. Accordingly, there is a need in the prior art to provide a relatively economical and easily assembled construction that meets each of the above-identified demands.

SUMMARY OF THE INVENTION

The present invention provides an improvement to a modular sound-absorbing office screen system of the general type disclosed in U.S. Pat. No. 3,934,382.

Disclosed herein is an improved sound-absorbing office screen system utilizing a hollow rigid, substantially U-shaped channel frame that both encircles and supports a central sound-absorbing panel. Each frame member forms an individual module that is capable of being interconnected to other frame members to form a predetermined screen partition configuration. The vertical support bottom portion of each channel frame member is adapted to receive means for relatively adjusting the position of a support member and the rigid frame. In this regard, a fastener member can be attached to the interior of the rigid frame member to assist in forming an aperture receiving a guide sleeve. This aperture is adapted to slidingly receive an upright channel portion of a detachable support leg. Operatively associated with the fastener means, directly or supplementally, is a threaded aperture for receiving a helically threaded force bearing member such as a bolt. By appropriate rotation of the bolt member, the relative position of the frame member and the contact surface of the support member can be subjectively adjusted.

An additional embodiment of the present invention is capable of removably receiving a leg extension member capable of closing the open face of the vertical channel member and permitting adjustment of the screen partition at a distance from the support leg.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DESCRIPTION OF THE PREFERRED EMBODIMENTS

Figure 1:
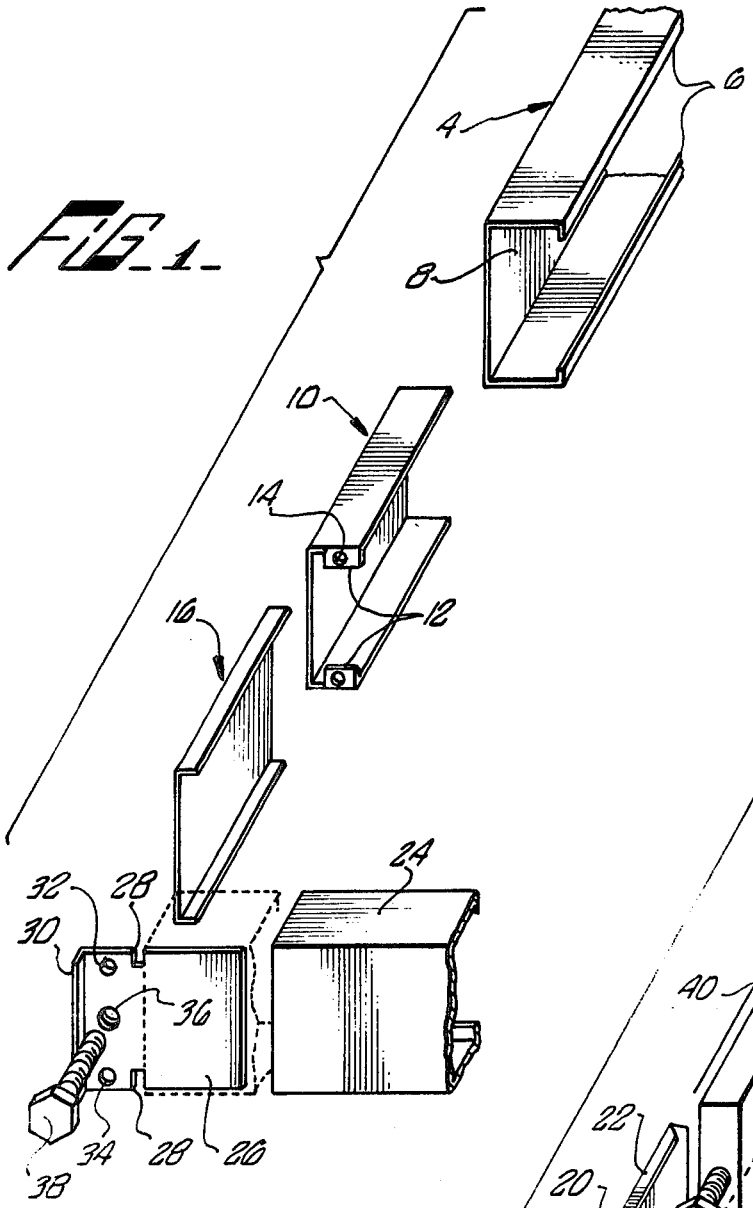
FIG. 1 is a partial exploded perspective view of one embodiment of the present invention.

The following specification taken in conjunction with the drawing sets forth the preferred embodiment of the present invention in such a manner that any person skilled in the modular wall or screen field can use the invention. The embodiments of the invention disclosed herein are the best modes contemplated by the inventor for carrying out his inventions in a commercial environment, although it should be understood that various modifications can be accomplished within the parameters of the present invention.

Reference is made herein to U.S. Pat No. 3,934,382 issued to Clifford W. Gartung on Jan. 27, 1976, and the same is hereby incorporated by reference to supplement the present disclosure in accordance with M.P.E.P. S608.01(p). Specifically the subject matter of the modular sound-absorbing screens as set forth in the drawings and specification is incorporated to supplement the following description.

Referring to FIG. 1, the lower portion of a modular screen assembly 2 is disclosed in an exploded perspective view and more particularly a bottom portion of the vertical frame rigid channel member 4, is disclosed. The channel member 4, can be of a cold rolled steel having parallel inwardly extending peripheral edge members 6 lying in a plane parallel to that of the channel base 8. In the interest of economy, the tolerance dimensions of the frame channel member 4, can be relatively large.

A fastener member 10 has a U-shaped configuration terminating at one end with a pair of integral inwardly extending tab members 12. Each tab member has an aperture 14 for receiving appropriate fasteners such as metal screws (not shown). As can be appreciated the fastener member 10 can be formed from a sheet of steel with its legs and tabs simply pressed into the desired configuration. The height of the fastener member 10 is of such a dimension to fit closely within the channel member 4 and is capable of being spot-welded therein. The width of the fastener member 10 is of such a dimension that the open faced edge of the fastener member can bear against the internal surface of the channel member edges 6 and create an aperture on the fastener members other side adjacent the channel base 8.

A guide sleeve 16, also having roughly a U-shaped configuration is dimensioned to fit within the aperture created between the channel base 8 and the fastener 10. The guide sleeve 16 can be punched to relatively close tolerances from a sheet of plate metal and is of the same height as the fastener 10. The guide sleeve 16 thus removes any requirement of close tolerances for the frame channel member 4. The guide sleeve 16, like the fastener member 10 can be spot-welded within the rigid channel member 4.

Figure 2:
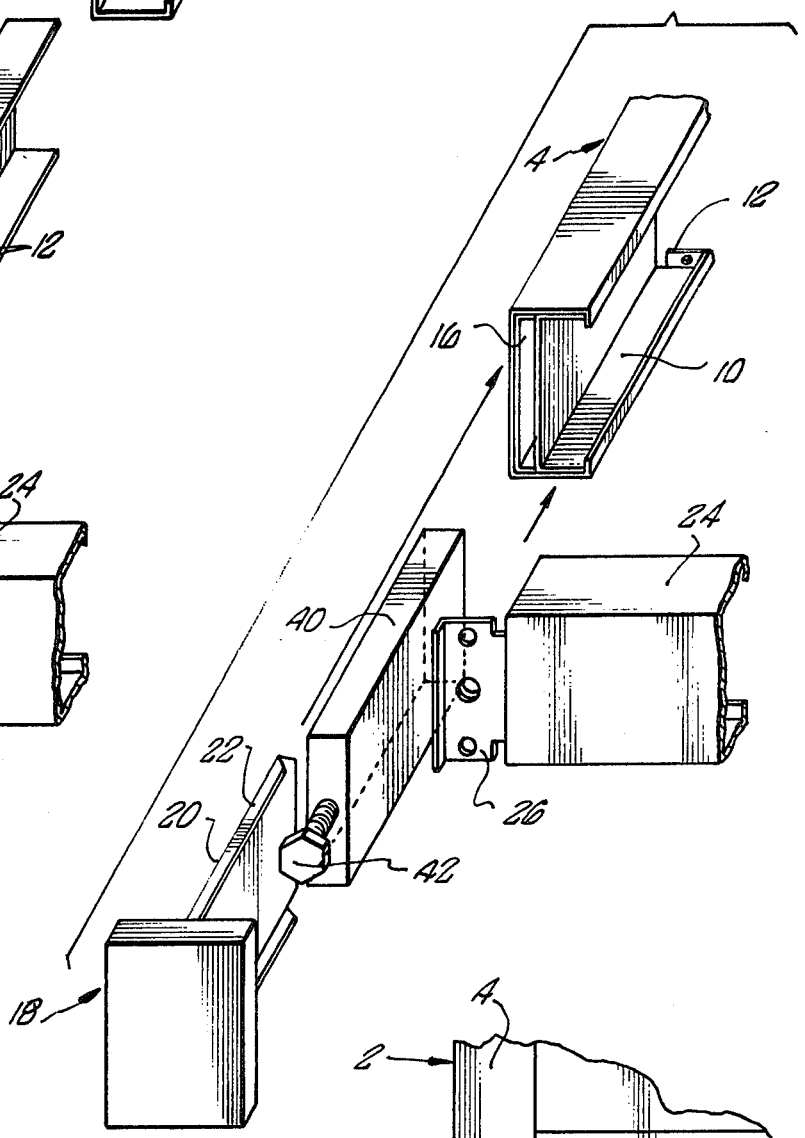
FIG. 2 is a partial exploded perspective view of a second embodiment of the present invention.

Referring specifically to FIG. 2, a foot support member 18 having an upright male channel 20 is designed to be relatively movable within the female aperture defined by the guide sleeve 16 and the fastener 10. The upright channel 20 has relatively small edge extensions 22 that are approximately one-ninth the width of the base portion of the upright channel. The small edge extension 22 save in the use of metal compared to the prior foot supports while still providing both strength and guide surfaces. The dimension of this upright channel 20 is such as to fit flush within the guide sleeve 16. As can be appreciated, by reference to the U.S. Pat. No. 3,934,382, various numbers of upright channels can be provided on the base of the foot support member 18 for connecting two, three or four panel modules together depending upon the specific wall partition configuration desired.

The module horizontal frame channel member 24 is identical in construction and configuration to a side segment of the vertical frame channel member 4. Plate members 26, as can be seen in FIGS. 1 and 2, are adapted to be spot-welded to the horizontal channel member 24 to provide connection with the vertical frame channel members 4. The plate member 26 has a pair of notches or guide indents 28 on its periphery and a ledge member 30. A pair of holes 32 and 34 are adapted to receive fasteners such as metal screws (not shown) and are positioned to align with the threaded apertures 14 in the tab members 12 on the fastener 10 when assembled. The position of the indents 28 are such to slidingly receive and be locked on the edge members 6 of the vertical channel member 4. The ledge member 30 is positioned to align with the base portion of the fastener 10 and to lie flush with the bottom of the vertical channel member 4 when inserted and fastened within the channel member 4. A central threaded aperture 36 is designed to receive a force bearing member 38 such as a threaded bolt. To realize economy in the construction of this part, the sheet metal plate member 26 can be reinforced with a spot-welded threaded metal blank thereby permitting the use of a thinner plate member that can be readily bent to form the ledge member 30.

Generally, the vertical frame channel member 4 is formed into a U-configuration having an open bottom as can be seen in U.S. Pat. No. 3,934,382. Sound-absorbing material with or without an inner reinforcing plate can be inserted within the rigid frame channel member. The horizontal channel member 24 carries, at either end, plate members 26 that have been spot-welded to the interior of channel member 24.

The guide sleeve 16 is inserted within each end of the verticle frame channel member 4 and is also spot-welded. The fastener 10 can likewise be inserted adjacent to the guide sleeve 16 and again spot-welded into place so that the tabs 12, in the embodiment of FIG. 1, are positioned adjacent to the guide sleeve 16 but recessed approximately three-eights of an inch from the bottom of the frame channel member 4. After the sound-absorbing material is inserted, the horizontal bottom channel member 24 can be mounted so that the plate member 26, notches 28 receive the respective edge members 6 of the vertical channel members 4. Channel member 24 is then moved relatively upward within the vertical frame channel member 4 to encompass the bottom edge of the sound-absorbing material until the tabs 12 on the fastener 10 abut against the plate member 26 and the respective apertures 14 are aligned with the holes 32 and 34 in the plate member 26. Appropriate metal screws (not shown) can be utilized to fasten the respective channel members together. As can be appreciated, the abutting end surfaces of the horizontal channel member 24 against the edge members 6 of the vertical channel members 4 provides additional strength and stability to the wall partition module.

Figure 3:
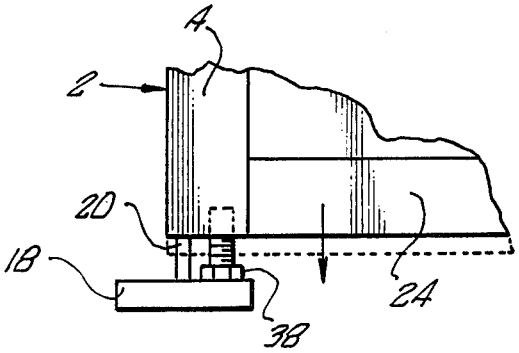
FIG. 3 is a side partial view of an assembled first embodiment of the present invention.

A foot support member such as the support member 18 can then be inserted within the aperture encompassed by the guide sleeve 16. The ledge member 30 forms a part of the entrance of the aperture for receiving the male upright channel 20 of the foot support member 18. The dimensions of the edge extensions 22 are such to provide a slidable but relatively close fit in the aperture. The surface of the base of the foot support member 18 can contact the force bearing member 38, and by relative rotation of the force bearing member 38, the relative position of the assembled wall partition channel member frame can be adjusted relative to the foot support member 18. This adjustment can be seen in FIG. 3 in the phantom lines.

Figure 4:
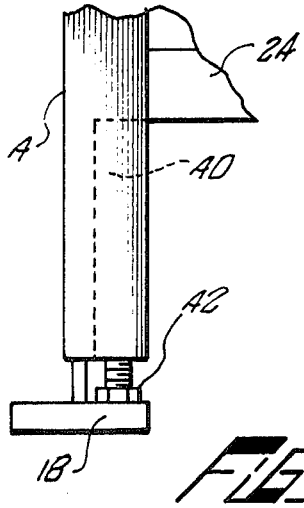
FIG. 4 is a side partial view of an assembled second embodiment of the present invention.

Referring to FIG. 2, a fragmentary exploded perspective view of a second embodiment of the present invention is disclosed. A partial view of this embodiment is further disclosed in FIG. 4. The same vertical frame rigid channel member 4, guide sleeve 16 and fastener 10, are again joined together thus realizing an economy of component parts. The fastener 10 however, is inverted so that the tabs 12 are positioned at a distance from the end of the vertical channel member 4. In this position, the horizontal channel member 24 can be slid upward for fastening with the tabs 12 and thereby convert the lower portion of the vertical frame channel member 4 into extensions or legs to create a space between the floor and the bottom of the modular screen partition.

As can be seen in FIG. 2, the fastener 10 is spot-welded to the interior of the vertical frame channel member 4 so that it is flush with the bottom of the channel member. Again, an aperture for receiving a foot support member 18 is provided between the guide sleeve 16 and the fastener 10. To improve both the esthetic appearance and to permit an operative adjustment of the foot support member 18 and the rigid frame, an extension leg member 40 is provided and is adapted to be slid within the fastener 10 to close the open face of the vertical frame channel member 6.

At one end of the leg member 40, a threaded aperture is designed to receive a force bearing member 42. The function of the force bearing member 42 is the same as that disclosed in FIG. 1, as can be seen from the partial side view shown in FIG. 4. Accordingly, a relative adjustment of the foot support member 18 to that of the rigid screen frame is possible to compensate for any variations in the elevation of the floor.

Thus, in both embodiments of the present invention, fastener means are attached to the interior of the vertical channel member 4 and are adaptable to receive force bearing means for providing a relative adjustment of the foot support member and the rigid screen frame. The particular individual components are specifically designed to be easily assembled and of a relatively inexpensive construction. Various modifications of these component parts are possible within the parameters of the present invention and accordingly, the scope of the present invention should be measured solely from the following claims, in which I claim.

What is claimed is:

1. An improved modular sound-absorbing office screen system comprising;

a first hollow rigid frame having an upper horizontal U-shaped channel member and a pair of side U-shaped channel members, each with inwardly extending peripheral edge members, fastened together;

a wall panel mounted within the hollow rigid frame;

a second lower horizontal U-shaped channel member;

plate members extending from each end of said second channel member and having means for laterally fastening said second channel member to each of said side U-shaped channel members adjacent said wall panel;

a fastener member mounted within each side channel member for fastening respectively to one plate member; and foot support members movably mounted between said fastener members and said side channel members for vertically supporting said screen system.

2. The invention of claim 1 further including means for independently adjusting the relative position of each foot support member and said hollow rigid frame.

3. The invention of claim 2 further including a guide sleeve member mounted between said fastener member and said side channel members for receiving said foot support member.

4. In an improved modular sound-absorbing office screen system, having a hollow rigid frame member of substantially a U-shaped channel member with at least side peripheral edge members approximately parallel to the side base surface and defining an open face and a central sound-absorbing panel supported by the frame, the frame member capable of being interconnected to other frame members to form a predetermined partition configuration, the improvement comprising;

fastener means attached to the interior of the rigid frame member for forming an aperture with the rigid frame member;

a relatively movable rigid foot support member mounted in the aperture for maintaining a desired alignment of the screen system, and means operatively associated with the fastener means for relatively adjusting the support member and the rigid frame including a plate member having guide indents for receiving and being laterally retained by the peripheral edge members of the frame channel member and a relatively movable force bearing member.

5. The invention of claim 4 further including a guide sleeve member mounted in the aperture.

6. In an improved modular sound-absorbing office screen system, having a hollow rigid frame member and a central sound-absorbing panel supported by the frame, the frame member capable of being interconnected to other frame members to form a predetermined partition configuration, the improvement comprising;

fastener means attached to the interior of the rigid frame member for forming an aperture with the rigid frame member;

a guide sleeve member having traversely extending edge members relative to its base mounted in the aperture;

a relatively movable rigid foot support member having a base and an outwardly extending male channel with peripheral edges, the support member channel being dimensioned to fit totally within the guide sleeve member for maintaining a desired alignment of the screen system, and means operatively associated with the fastener means for relatively adjusting the support member and the rigid frame.

7. The invention of claim 6 wherein the hollow rigid frame member is substantially a U-shaped channel member, the means for relatively adjusting the foot support member and the rigid frame includes a leg extension member dimensioned to fit within the fastener member and closing the open face of the frame channel member.

8. In an improved modular sound-absorbing office screen system, having a hollow rigid frame member of substantially a U-shaped channel member with an open face and a central panel supported within the open face of the frame member, the frame member capable of being interconnected to other frame members to form a predetermined partition configuration, the improvement comprising;

fastener means, including a U-shaped member having at its end furthest from the end of the U-shaped frame channel member a pair of inwardly extending tabs;

a leg extension member dimensioned to fit within the fastener member to abut the inwardly extending tabs and closing the open face of the frame channel member;

a relatively movable rigid foot support member operatively connected to the rigid frame member, and means for relatively adjusting the foot support member.

9. The invention of claim 8 wherein , the hollow rigid frame member is substantially a U-shaped channel member with peripheral edge members parallel to its base surface and defining an open face, the means for relatively adjusting the foot support member and the rigid frame includes a plate member and a relatively movable force bearing member having guide indents for receiving and being laterally retained by the peripheral edge members of the frame channel member.

10. The invention of claim 6 wherein the fastener means includes a U-shaped member having at one end, inwardly extending tabs for receiving the means for relative adjustment.

11. In an improved modular sound absorbing office screen system having a hollow rigid frame member of substantially upper, lower and side U-shaped channel members with peripheral edge members approximately parallel to the base surface on at least the side channel members, the improvement comprising;

first and second members having guide indents for receiving and being laterally retained by the peripheral edge members of the side channel members are attached to either end of the lower U-shaped channel member;

fastener means for attaching the first and second members to respective side channel members;

relatively movable foot support members operatively connected to each respective side channel member for maintaining a desired alignment of the screen; and means operatively associated with each foot support member for adjusting the foot support member relative to the rigid frame member.

12. The invention of claim 11 further including a guide sleeve member mounted in each side channel member for receiving a foot support member.

13. The invention of claim 11 wherein the means for adjusting the support member includes a force bearing member mounted for relative movement on each of the first and second members.

14. The invention of claim 12 wherein the fastener means includes a cross section U-shaped member mounted adjacent the guide sleeve member whereby the foot support member is movably mounted between the guide sleeve and the U-shaped fastener member.

15. The invention of claim 11 wherein the means for relatively adjusting the support member includes a force bearing member mounted for helical movement between the rigid frame member and the foot support member.

16. The invention of claim 14 wherein the foot support member has a base and an outwardly extending male channel with peripheral edges and the guide sleeve member has traversely extending edge members relative to its base, the support member channel being dimensioned to fit totally within the guide sleeve member.

17. The invention of claim 11 wherein the fastener means includes a U-shaped member having at its end furthest from the end of the U-shaped frame channel member, a pair of inwardly extending tabs, and further including at least one adjustable leg extension member abutting the inwardly extending tabs.

18. The invention of claim 17 wherein the adjustable leg extension member includes a force bearing member contacting its respective foot support member for adjusting the foot support member relative to the rigid frame.

* * * * *